United States Patent [19]

Fetterman

[11] 4,357,096

[45] Nov. 2, 1982

[54] DISPERSION SUPPLY APPARATUS FOR PHOTOELECTROPHORETIC MIGRATION IMAGING

[75] Inventor: Clyde L. Fetterman, Spencerport, N.Y.

[73] Assignee: Eastman Kodak Company, Rochester, N.Y.

[21] Appl. No.: 241,302

[22] Filed: Mar. 6, 1981

[51] Int. Cl.[3] ..... G03G 15/00

[52] U.S. Cl. ..... 355/3 P; 355/3 R; 118/625; 118/627; 118/629; 118/659; 430/199

[58] Field of Search ..... 355/3 P, 3 R, 14 R, 355/3 TR, 3 DD, 10; 118/627, 659, 621, 625, 629, 628; 430/199

[56] References Cited

U.S. PATENT DOCUMENTS

| | | | |
|---|---|---|---|
| 3,221,992 | 12/1965 | Sedlacsik, Jr. et al. | 118/627 X |
| 3,600,081 | 8/1971 | Egnaczak | 355/3 |
| 3,656,173 | 4/1972 | Fussel | 118/659 X |
| 3,664,297 | 5/1972 | Donalies | 118/627 |
| 3,703,459 | 11/1972 | Little, Jr. et al. | 204/300 |
| 3,722,994 | 3/1973 | Tanaka et al. | 118/659 X |
| 3,769,009 | 10/1973 | Wells et al. | 96/1 R |
| 3,921,580 | 11/1975 | Kase | 118/659 X |
| 4,109,027 | 8/1978 | Crose | 118/627 X |
| 4,126,711 | 11/1978 | Marlow | 118/659 X |

FOREIGN PATENT DOCUMENTS

| | | |
|---|---|---|
| 1324102 | 7/1973 | United Kingdom . |
| 1337419 | 11/1973 | United Kingdom . |

*Primary Examiner*—A. C. Prescott
*Attorney, Agent, or Firm*—John D. Husser

[57] ABSTRACT

Migration imaging apparatus of the kind using a photoelectrophoretic dispersion and having an electrode moveable along an endless operative path past dispersion application and imaging zones features improved dispersion applicator structure comprising a flat-spray, atomizing nozzle adapted to form a uniform layer of dispersion on the electrode without imparting velocity perturbations to the moving electrode.

9 Claims, 5 Drawing Figures

DISPERSION SUPPLY APPARATUS FOR PHOTOELECTROPHORETIC MIGRATION IMAGING

BACKGROUND OF THE INVENTION

1. Field of the Invention

The present invention relates to migration imaging apparatus and more specifically to improved structure for forming an imaging layer of photoelectrophoretic dispersion on electrode structure of such apparatus.

2. Description of the Prior Art

Briefly, conventional photoelectrophoretic migration imaging involving presenting an imaging layer (including a dispersion of photoconductive toner particles in a carrier or binder) in an electrical field between opposing electrode surfaces and imagewise exposing the layer. The opposing electrodes are often referred to as blocking and injecting electrodes (respectively having an insulating and conductive interface with the imaging layer); and, upon imagewise exposure, the toner particles migrate in an imagewise manner to form negative and positive images on the respective electrodes. There are a number of variations of this imaging technique. For example, U.S. Pat. No. 3,976,485 discloses a photoimmobilized migration imaging approach (wherein a negative image forms on the blocking electrode instead of the injecting electrode), and U.S. Pat. No. 4,168,118 discloses a field address photoelectophoretic technique (wherein discrete pixels of the image lyer are addressed by discrete electrical fields in the presence of flood illumination).

In the above and other similar imaging approaches using such an imaging dispersion, it is important to provide a dispersion layer of uniform thickness in the imaging zone (i.e. in the presence of the imaging field and illumination). A usual way of effecting this requirement is to provide an applicator that forms such a layer of the dispersion on one of the electrodes as the electrode moves from an upstream position to the imaging zone.

Although no commercial apparatus has yet evolved from this technology, a number of different, structures for continuous operation have been described, e.g. in patent literature. In such apparatus descriptions, several different dispersion application approaches are proposed. The most frequently proposed approach appears to be using an extrusion device which forms a bead of dispersion on the electrode, in cooperation with a doctor blade, which skives the extruded layer to the desired thickness. Another commonly disclosed approach is to use a donor roller that is partially immersed in a supply of dispersion, and which on rotation carries dispersion from the supply to an electrode. Yet another approach is to move the electrode directly through such a dispersion supply container and then smooth the layer with a downstream doctor blade on roller.

While all of the above applicator techniques appear technically feasible, I have found that, for certain commercial applications, those techniques present potential difficulties. More particularly, I have noted that prior art modes of applying dispersion all impart perturbations that cause the velocity of one or both of the apparatus electrodes to vary at a relatively high frequency. Such variation of the electrode velocity, commonly called "flutter", is particularly detrimental when the electrodes are addressed on a line-by-line basis, e.g. with a scanning laser modulated by an electronic image signal. In that kind of imaging mode electrode velocity "flutter" creates a highly objectionable image artifact termed "banding", which is a high frequency density variation within the image. This objectionable density variation occurs because the above-noted electrode velocity variations cause non-uniformity in the line-to-line spacing of scanned picture elements. Thus in migration imaging applications of the kind described above and analogous applications, it is particularly desirable that imaging dispersion be applied to the electrode in a manner avoiding perturbation of the electrode movement.

SUMMARY OF THE INVENTION

It is a significant purpose of the present invention to provide for migration imaging apparatus, improved dispersion applicator structure which obviates the problems of the kind described above. It is a further advantage of the present invention to provide migration imaging apparatus having applicator structure which supplies migration imaging dispersion to a moving electrode with minimal perturbations and in a highly uniform, readily controllable manner.

In general, the foregoing and other advantages are achieved in accordance with the present invention by providing an improved dispersion applicator device in migration imaging apparatus of the kind using an imaging layer, including a liquid dispersion electrophotosensitive image particles and a carrier, such apparatus having: (1) a dispersion imaging zone and a dispersion application zone, (2) means for transporting a layer of such dispersion from said application zone to said imaging zone and (3) means for subjecting such liquid a transported layer to migration image inducing electrical field and illumination. The improved dispersion applicator device comprises atomizing spray means, located proximate said application zone, for directing a fluidized stream of such liquid dispersion to form continuous, uniformly thick imaging layer on said transporting means.

BRIEF DESCRIPTION OF THE DRAWINGS

The subsequent description of preferred embodiments is made in connection with the accompanying drawings wherein.

DETAILED DESCRIPTION OF THE PREFERRED EMBODIMENTS

Figure 1:
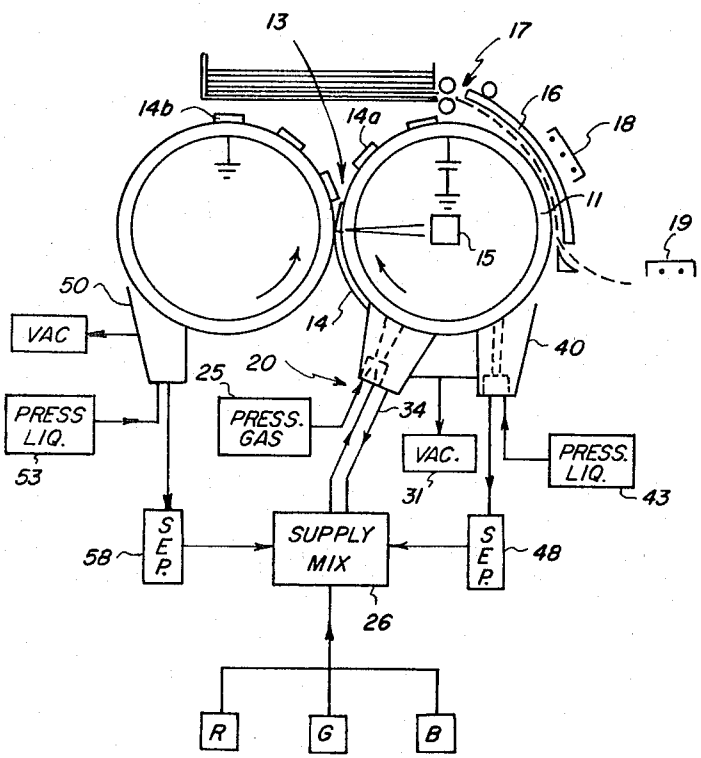
FIG. 1 is a schematic illustration of one embodiment of migration imaging apparatus incorporating the present invention.

The embodiment of migration imaging apparatus 10 shown in FIG. 1 comprises cylindrical injecting and blocking electrodes 11 and 12 respectively, mounted for rotation on parallel axes so as to form a contacting nip at a migration imaging zone, designated generally 13. As indicated schematically an electrical potential is provided across the imaging zone, e.g. by coupling injecting electrode 11 to a source of DC voltage and coupling blocking electrode 12 to ground. In one common migration imaging technique, injecting electrode 11 is formed of an electrically-conductive, transparent material and the outer surface of blocking electrode 12 is electrically insulative.

The electrode cylinders are rotated in opposite directions as indicated; and as their successive portions pass the imaging zone 13, the portions of migration imaging dispersion layer 14 therebetween are imagewise illuminated by imaging means 15, e.g. an imagewise modulated laser or means for directing successive portions of a projected image into the imaging zone. Illuminated portions of the suspension 14*a* migrate to the blocking electrode 12 and non-illuminated portions 14*b* migrate to the injecting electrode 11. Thus positive and negative images, corresponding to the exposing illumination pattern, are formed respectively on the injecting and blocking electrodes. Downstream from the imaging zone, a transfer sheet 16 is fed by suitable feed means 17 into transfer relation with the positive image on the injecting electrode 11, and corona discharge device 18 effects transfer of the dispersion image 14*a* to sheet 16. Heating means 19 typically are provided to finally fix the dispersion on receiver sheet 16.

The structure of the migration imaging apparatus 10 thus far described is conventional and only exemplary of many different structural configurations and functional approaches for achieving migration imaging. However, one feature which the FIG. 1 apparatus has in common with most migration imaging modes is that the imaging dispersion 14 is transported into the imaging zone 13 by one of the electrodes onto which it is applied at an application zone located upstream (with respect to the direction of electrode movement) from the imaging zone. The present invention pertains to improved means (denoted generally 20 in FIG. 1) for applying a uniform layer of migration imaging dispersion to such an electrode, or analogous member, for transport into the imaging field and illumination at the imaging zone.

Figure 3:
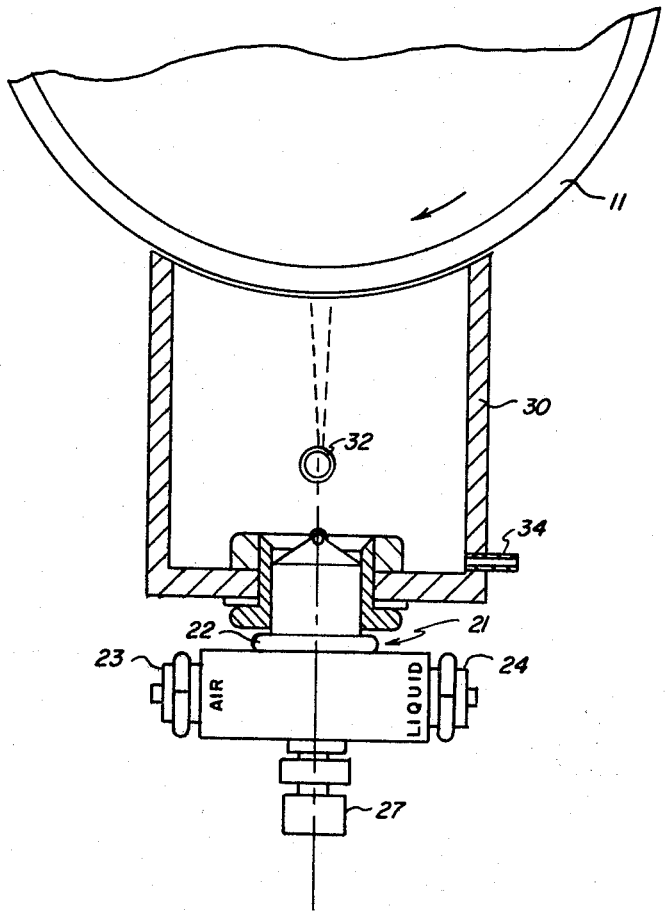
FIG. 3 is an enlarged cross-sectional view of the dispersion applicator device shown in FIGS. 1 and 2, illustrating one preferred configuration in accord with the present invention.

Referring to FIG. 3, as well as FIG. 1, the details of one preferred structure for applying dispersion in accordance with the present invention can be further understood. Thus, the applicator means 20, in general, comprises a nozzle 21 for spraying imaging dispersion onto the electrode 11 at a location upstream from imaging zone 13.

It is highly preferred in accordance with the present invention that the application nozzle be of the flat-spray, atomizing kind. The flat-spray nozzle characteristic forms a narrow-rectangle or strip-like intersection pattern across the electrode, which is desirable from the viewpoint of dispersion thickness uniformity. The atomizing nozzle characteristic facilitates uniformity of coverage with a reduced quantity of dispersion which is highly desirable because a build-up of excess dispersion at the nip of the electrodes has an adverse effect on image quality.

The atomizing, flat-spray nozzle 21 preferably is of the internal mix type and comprises an internal mixing chamber portion 22 and conduits 23 and 24 respectively for passing streams of gas and liquid dispersion to chamber 22. Pressurized supplies 25 and 26 (FIG. 1) respectively feed fluidizing gas and imaging dispersion to chamber 22 and an adjustable needle valve 27 is provided to control, in conjunction with the pressure of sources 25 and 26, the volume of fluid passing through the nozzle. The nozzle orifice is selected, in conjunction with other system parameters, to effect the spray configuration that produces the proper intersection pattern for the spray from the nozzle where the spray contacts the moving electrode. That is, the spray intersection pattern is a function of a number of parameters, e.g. the distance of the nozzle orifice from the electrode, the dispersion viscosity, the pressure of the introduced gas and dispersion as well as the orifice configuration. These parameters are adjusted, based on the velocity of the moving electrode, to achieve the desired thickness of the dispersion layer. Atomizing, flat-spray nozzles of the kind described are available commercially in a large variety of configurations designed to accommodate the above-mentioned parameters of a particular application. For example, one exemplary preferred nozzle is an atomizing, flat-spray nozzle N-13 sold by Spraying Systems Co. of Wheaton, Ill. Using such nozzle, imaging dispersion was supplied at a pressure of 10 psi and an atomizing air was supplied at a pressure of 30 psi. The nozzle was positioned to form a flat-spray intersection with the electrode about 3-¾ inches in length, with the length of the spray intersection pattern substantially perpendicular to the direction of electrode movement. With this general arrangement electrodes moving at rates in the 1.5 to 6.0 inches/sec. range were successfully provided with a uniform dispersion layer suitable for migration imaging. The volume rate of fluid is adjusted by adjustment of needle valve and fluid pressures to obtain precisely desired dispersion layer thickness on the electrode. One exemplary preferred volume rate is about 1.2 liters/hr. for an electrode moving at about 5.5 inches/sec.

In preferred embodiments of the present invention, a housing 30 is provided to substantially enclose the space between the nozzle 21 and the portions of the electrode 11 moving therepast. The housing is preferably formed of low conductivity material to avoid arcing and is constructed and mounted to form a small gap (e.g. 0.005 to 0.010 inch) between itself and the passing electrode, at least on the downstream edge. This gap allows undisturbed passage of the applied dispersion layer; however, it also provides for the possible escape of dispersion spray. Thus, it is further preferred, in accord with the invention, that a slight negative pressure be maintained in the space enclosed by housing 30. This is accomplished by coupling a negative pressure source 31 (FIG. 1) to the housing e.g. by conduit 32. This construction effectively contains the spray within housing 30. Filter means can be provided to prevent spray from passing to the vacuum source. Excess spray collectors in the bottom of the housing 30 and is fed back to the supply 26 by drain 34, where it can be reused.

Figure 4:
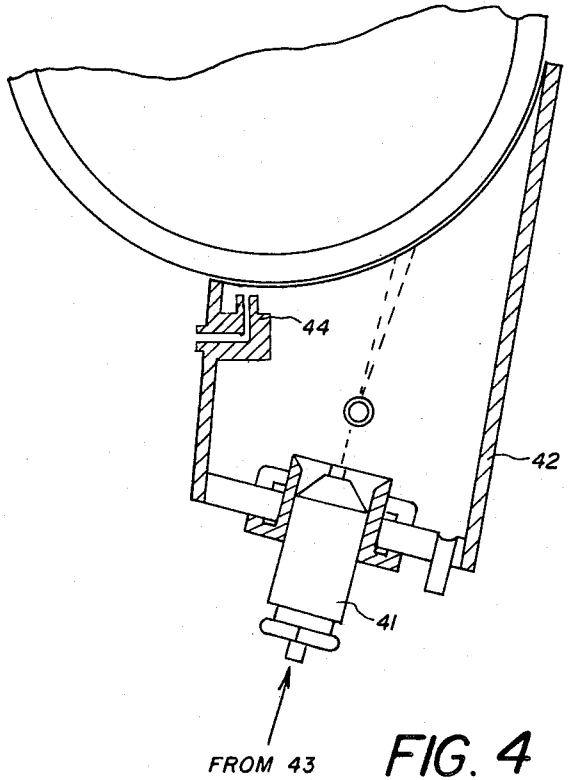
FIGS. 4 and 5 are cross-sectional views of preferred cleaning constructions for migration imaging apparatus in accordance with the present invention.
Figure 5:
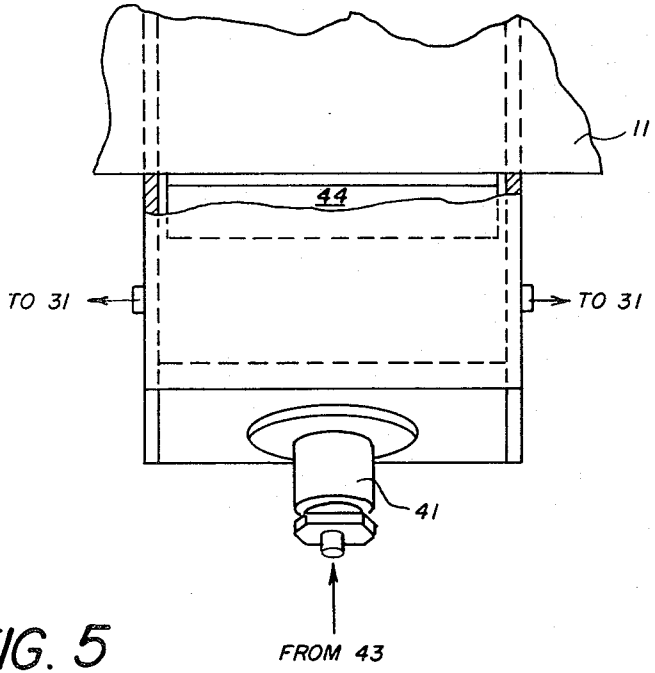

FIGS. 1, 4 and 5 show one desirable configuration for cleaning electrode 11 without introducing significant velocity variations. Thus a flatspray, pressurized liquid, nozzle 41, is located in housing 42 to direct cleaning liquid (e.g. conventional cleaning solvent) under pressure, from supply 43, obliquely toward a portion of the electrode path in a manner providing a high shear force on any dispersion which remains on the electrode 11 after transfer. One preferred nozzle for use as shown in FIGS. 3 and 4 is a Spraying Systems Co., flat-spray, pressurized liquid nozzle No. 730023. The cleaning station housing 42 is formed like housing 30 and vacuum source 31 likewise creates a slight negative pressure containing the cleaning spray within housing 42. Preferably, an air knife 44 is provided in the housing 42 to remove excess cleaning liquid from the electrode. Cleaning station 50 is constructed like cleaning station 40 and removes the negative image dispersion portions from blocking electrode 12.

The dispersion removed from electrodes 11 and 12 by cleaning stations 40 and 50 is collected by particle separator units 48 and 58 and fed back to supply 26. To maintain the proper concentration of image particles in the supply 26, particle concentrate is supplied, e.g. from red (R), green (G) and blue (B) electrophotosensitive pigment supplies, when working in three colors. A particle concentration monitor (not shown) is provided to control the supply of red, green and blue particles. The dispersion in supply 26 desirably is agitated continuously during operation to prevent particle agglomeration and resultant nozzle clogging.

Figure 2:
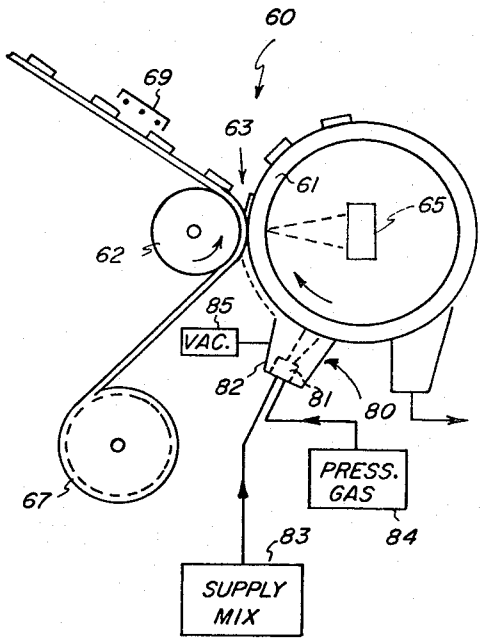
FIG. 2 is a schematic illustration of another embodiment of migration imaging apparatus incorporating the present invention.

Considering the foregoing, it will be appreciated that the present invention provides a highly useful structure for applying and removing imaging dispersion within velocity-sensitive migration imaging apparatus without the perturbations incident to prior art structures. It will be apparent to one skilled in the art that the present invention can be applied to various other structural configurations for migration imaging. FIG. 2 illustrates one other such embodiment; however, there are many others including field-addressing structures, such as disclosed in U.S. Pat. No. 4,168,118, as well as light-addressed structures, e.g. such as disclosed in U.S. Pat. No. 4,229,095.

In the FIG. 2 apparatus 60, the electrode structure is formed as disclosed in U.S. Pat. No. 3,976,485, with electrode 62 being a block electrode and electrode 61 being a dark charge exchange electrode. The liqid applicator means 80 including nozzle 81 and housing 82 are constructed like the structures of FIG. 1 and dispersion and gas streams are provided from sources 83 and 84 respectively for mixing in nozzle 81. Also vacuum 85 creates a negative pressure in housing 82 to contain the dispersion spray.

In the FIG. 2 embodiment, a positive image migrates toward the blocking electrode 62 when imagewise exposure from source 65 occurs. Thus, a supply of support material 67 can be fed through imaging zone 63 with the blocking electrode and a migration image formed directly thereon. This avoids transfer and the image can be fixed directly on the support by fuser 69.

The invention has been described in detail with particular reference to certain preferred embodiments thereof, but it will be understood that variations and modifications can be effected within the spirit and scope of the invention.

What is claimed is:

1. In migration imaging apparatus of the kind using an imaging layer comprising a liquid dispersion of electrophotosensitive image particles and a carrier, said apparatus having an imaging zone, a dispersion application zone, means moveable between said application and imaging zones for transporting such an imaging layer from said application zone through said imaging zone and means for subjecting such a transported layer to migration image inducing electrical field and illumination at said imaging zone, an improved device for applying such a layer on said transporting means, said device comprising atomizing nozzle means, located at said application zone, for spraying a continuous, uniformly thick layer of such liquid dispersion onto said transporting means.

2. The invention defined in claim 1 wherein said nozzle means comprises a flat-spray nozzle having the longitudinal dimension of its spray pattern oriented generally transverse to the direction of said transporting means movement.

3. The invention defined in claims 1 or 2 further including a housing substantially enclosing the space between said nozzle means and said transporting means and means for maintaining a negative pressure within said housing.

4. In migration imaging apparatus of the kind using an imaging layer comprising a liquid dispersion of electrophotosensitive image particles and a carrier, said apparatus having an imaging zone, an application zone, electrode means moveable along a continuous operative path passing said application zone and said imaging zone and means for subjecting dispersion transported on said electrode means to migration image inducing electrical field and illumination at said imaging zone, improved applicator means for applying a uniformly thick, continuous dispersion layer onto said electrode means, said applicator means comprising flat-spray, atomizing nozzle means, located at said application zone, for directing a fluidized spray pattern of such liquid dispersion onto said electrode means with the longitudinal dimension of said spray pattern oriented generally transverse to the direction of electrode means movement.

5. The invention defined in claim 4 further including a housing substantially enclosing the space between said nozzle means and said electrode means and means for maintaining a negative pressure within said housing.

6. The invention defined in claim 4 wherein said nozzle means comprises an internal mixing chamber and first and second conduit means respectively adapted to supply pressurized gas and quantities of such liquid dispersion to said chamber.

7. The invention defined in claim 4 further comprising flat-spray, pressurized liquid nozzle means located along the operative path of said electrode means, downstream from said imaging zone, for directing a high velocity stream of cleaning liquid onto said electrode means.

8. The invention defined in claim 7 further comprising a housing substantially enclosing the space between said nozzle means and said electrode means and means for maintaining a negative pressure in said housing.

9. The invention defined in claim 7 wherein said electrode means is a member having a cylindrical surface that is rotatable on its longitudinal axis for movement along said operative path and said liquid nozzle means is located to direct said liquid steam obliquely onto said electrode surface in a manner providing a high shear force on dispersion on said surface.

* * * * *